US007444833B2

(12) United States Patent
Schock

(10) Patent No.: US 7,444,833 B2
(45) Date of Patent: Nov. 4, 2008

(54) ONE WAY VENTURI FOR USE WITH A COLD FOG GENERATOR AND/OR NATURAL SMOKE/FOG DISTRIBUTION SYSTEM

(76) Inventor: William Schock, 3385 Orcutt Rd., Santa Maria, CA (US) 93455

( * ) Notice: Subject to any disclaimer, the term of this patent is extended or adjusted under 35 U.S.C. 154(b) by 113 days.

(21) Appl. No.: 11/182,585

(22) Filed: Jul. 14, 2005

(65) Prior Publication Data

US 2007/0012064 A1 Jan. 18, 2007

(51) Int. Cl.
*F25D 17/02* (2006.01)

(52) U.S. Cl. ..... 62/425; 62/387

(58) Field of Classification Search ..... 62/425, 62/387, 404, 419

See application file for complete search history.

(56) References Cited

U.S. PATENT DOCUMENTS

| | | | | |
|---|---|---|---|---|
| 4,811,901 | A * | 3/1989 | Stevens et al. | 239/138 |
| 4,818,843 | A * | 4/1989 | Swiatosz | 392/397 |
| 4,934,601 | A * | 6/1990 | Stevens et al. | 239/138 |
| 5,957,382 | A * | 9/1999 | Thomas | 239/135 |
| 6,805,307 | B2 * | 10/2004 | Dorendorf et al. | 239/398 |

* cited by examiner

*Primary Examiner*—Melvin Jones
(74) *Attorney, Agent, or Firm*—Andrew Schroeder, Esq.

(57) ABSTRACT

A venturi apparatus for use with a cold fog generator and/or smoke/fog distribution system comprising: a pipe having an air impeding object, a smoke producing means, an expansion chamber, and an ambient air chamber, said expansion chamber sized to fit with a smoke producing means, said expansion chamber sized to fit with said venturi, said cfgnsfds chamber and said smoke producing means chamber, said ambient air chamber located perpendicularly in relation to said cfgnsfds chamber and said ambient air chamber.

18 Claims, 10 Drawing Sheets

ONE WAY VENTURI FOR USE WITH A COLD FOG GENERATOR AND/OR NATURAL SMOKE/FOG DISTRIBUTION SYSTEM

CROSS-REFERENCE TO RELATED APPLICATIONS

Natural Smoke/Fog Distribution System;

A Cold Fog Generator and/or Natural Smoke/Fog Distribution System

FIELD OF THE INVENTION

The present invention is in the area of smoke machines and pertains more particularly to methods, apparatus, and systems for generating fog, flash freezing smoke and disbursing both to a remote location.

BACKGROUND OF THE INVENTION

Many entertainment events and other uses for smoke call for a heavy, thick, and low-lying fog effect. In order to produce a low-lying fog effect from a fluid smoke machine which will roll low over the ground, the smoke must be cooled significantly. If the hot smoke is not cooled significantly, it will rise, spread and dissipate. However, since smoke producing machines produce smoke at around 165°-200°, it quickly rises and dissipates if left unchanged.

Therefore, what is clearly needed in the art is a system, apparatus, and methods thereof for producing a low-lying fog effect which is cooled such that the fog and/or smoke will remain low over the ground and will not quickly rise and dissipate.

SUMMARY OF THE INVENTION

A venturi apparatus for use with a Cold Fog Generator and/or Natural Smoke/Fog Distribution System comprising: a pipe having gate or reed means, a fog producing means chamber, a cfgnsfds chamber, and an ambient air chamber, said fog producing means chamber sized to fit with a fog producing means, said cfgnsfds chamber sized to fit with a cfgnsfds, said cfgnsfds chamber and said fog producing means chamber located directly opposite each other, or in other placements, said ambient air chamber located perpendicularly in relation to said cfgnsfds chamber and said ambient air chamber, said gate or reed means being housed in said ambient air chamber.

In some preferred embodiments each of the three chambers is complimentarily threaded in order to receive and engage with its corresponding part. In some preferred embodiments the venturi apparatus may be made of either PVC or metal or other suitable materials.

BRIEF DESCRIPTION OF THE DRAWING FIGURES

DESCRIPTION OF PREFERRED EMBODIMENTS

According to a preferred embodiment of the present invention, a unique system, method, and apparatus is used to prevent compressed smoke or other gases from inlet orifice of chamber from leaching out of chamber. This, in turn forces the smoke and gases to be cooled within the chamber. The present invention is described in enabling detail below.

Figure 1:
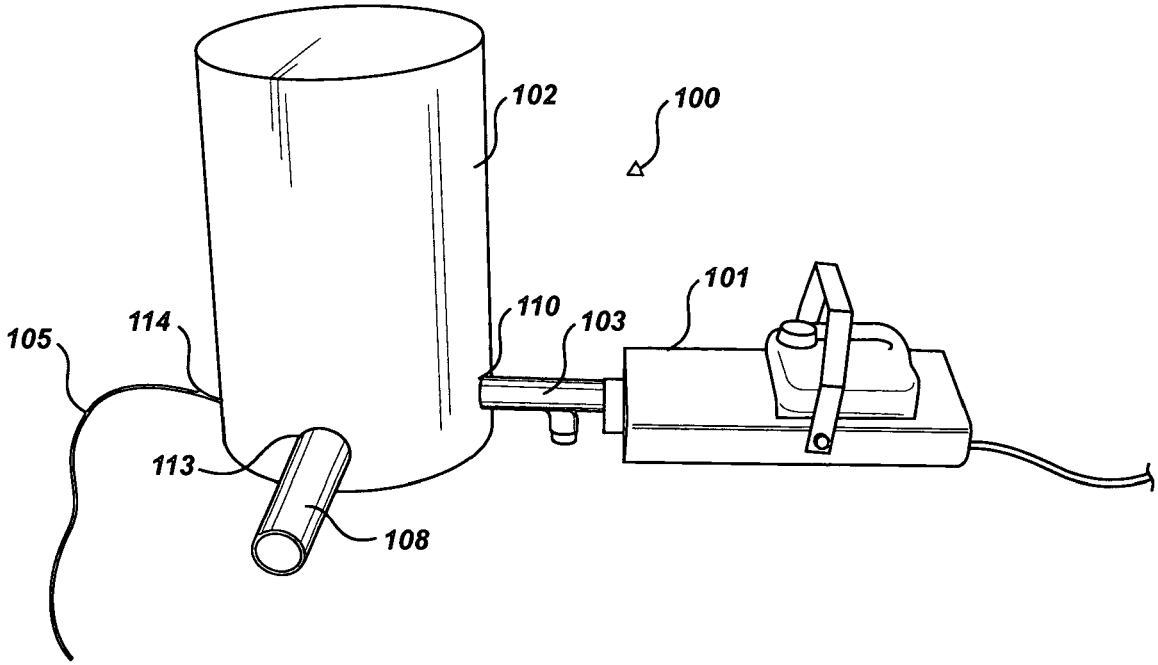
FIG. 1 is an isometric view of a preferred embodiment of the present invention.
Figure 2:
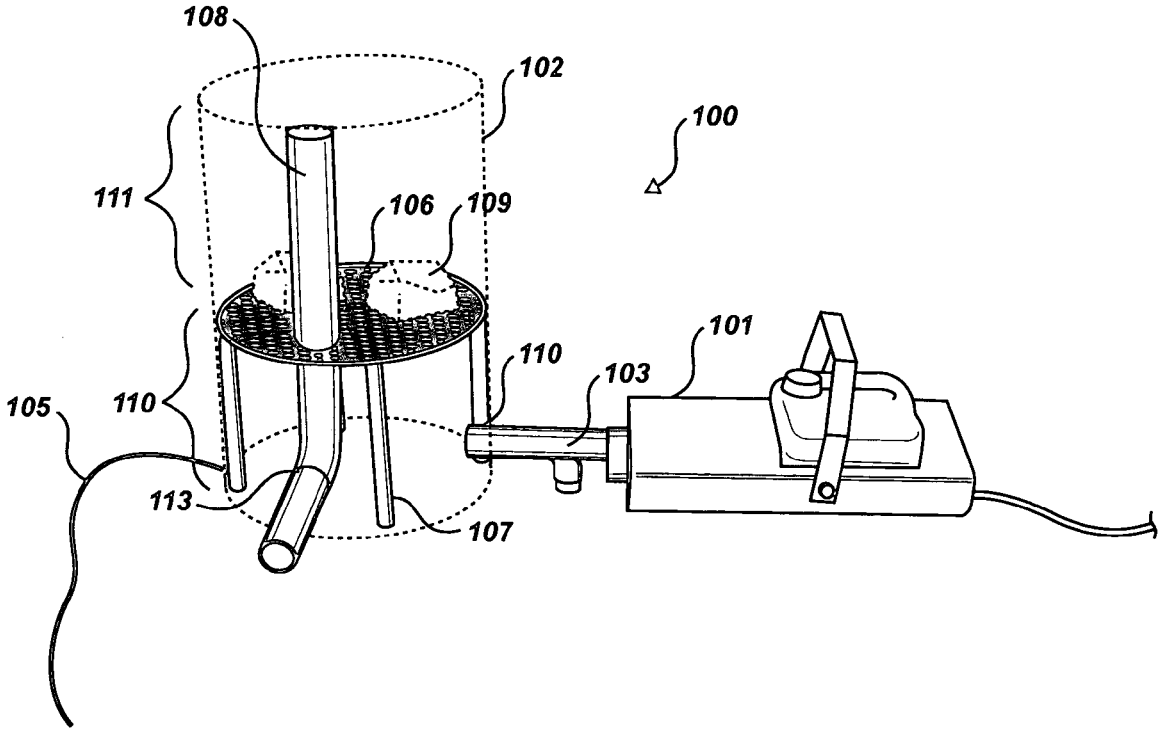
FIG. 2 is an isometric view of a preferred embodiment of the present invention.

FIG. 1 is a perspective view of a preferred embodiment of the present invention. Cold fog generator and smoke/fog distribution system 100 (hereafter cfgnsfds) comprises a smoke machine 101, a chamber 102, a one way venturi 103, (or in some preferred embodiments an inlet orifice 125 as illustrated in FIG. 1), and tubing 105. FIG. 2 illustrates the remaining elements: an ice tray 106, support apparatus 107, exhaust duct 108, ice 109, expansion chamber 110 and flash freeze chamber 111.

It should be pointed out here that cfgnsfds 100 in this preferred embodiment is a sealed system. Although cfgnsfds 100 possesses orifices, it is to be understood that the mentioning of these orifices is for the purpose of fabrication of the present invention.

Ice 109 is used for the purpose of cooling the smoke thereby enabling a low-lying fog-effect. In some preferred embodiments, ice 109 may be either regular ice or dry ice. For the purposes of clarity, the term ice 109 shall refer to both regular ice or dry ice. In some preferred embodiments no ice is used. Therefore, the specific use of ice is not specifically required. Other cooling means may be used to cool the ice.

Chamber 102 is a container with three orifices 125, 113, and. Inlet orifice 125 is where the smoke is directed through. Orifice 114 is where melting ice water drains from the chamber 102 (it should be pointed out here that in other preferred embodiments where ice is not used, orifice 114 and water drain tubing 105 will not be required). And orifice 113 is where fog exits from cfgnsfds 100.

Inside the chamber 102 is the exhaust duct 108. Exhaust duct 108 passes through wall of chamber 102 through orifice 1113. From the point of attachment, exhaust duct 108 has a length such that it traverses the height of both support apparatus 107 and ice tray 106. Exhaust duct 108 in a preferred embodiment is made of a garden-variety PVC piping material. However other materials and pipes may be equally expedient to constitute the exhaust duct 108. Therefore, the specific material and apparatus used to constitute the exhaust duct 108 is of no consequence.

However, it is not specifically required that the exact means of exhaust duct 108 be used. There are other means and ways of diverting fog out of cfgnsfds 100 without the use of exhaust duct 108.

Smoke machine 101 is the apparatus which produces the smoke. There abound many different types of smoke machines with which cfgnsfds 100 may be adapted to work. In a preferred embodiment, smoke machine 101 is attached to the one-way venturi 103. In turn, the one-way venturi 103 is attached to orifice 110 of chamber 102.

In preferred embodiments, the function of shutting down smoke flow from gate chamber 205 is accomplished through gate means 209, a trap door means, a spring means, reeds etc. A skilled artisan within the art will be able to enable a spring means, trap door means, or other means of shutting down air flow from expansion chamber 102. Therefore, the specific details shall not be detailed herein.

In order to attach the one-way venturi 103 to expansion chamber via orifice 110 both orifice 110 and one-way venturi 103 may be complimentarily threaded and sized to fit each other. However, it is not specifically required that the mode of attachment is via threading. Other modes of attachment such as gluing, soldering, etc. are equally expedient for the task, and will be readily understood by one skilled in the art.

Chamber 102 is a sealed container and may embody many different shapes and sizes. FIG. 2 illustrates that chamber 102 comprises both the expansion chamber 110 and the flash freeze chamber 111. The expansion chamber 110 in this specification shall mean the region of the chamber 102 below the ice tray 109. The region above ice tray 109 is the flash freeze chamber 111.

The main purpose of the expansion chamber 110 is to provide the natural engine for pushing out the smoke. Since the present invention does not use fans or other exhaust means in order to inject smoke out of cfgnsfds 100, the expansion chamber 110 must accomplish this function. Expansion chamber 110 works by closing inlet to allow pressure to build up naturally within expansion chamber 110 thereby forcing smoke and fog out of exhaust duct 108.

The main function of flash freeze chamber 111 is to cool the smoke. The cooling of the smoke accomplishes two main objectives. First, a cold smoke is more apt to lie low over the ground, which is desirable in the entertainment industry. Second, a cold smoke is much slower to rise and dissipate than a warm smoke.

Figure 8:
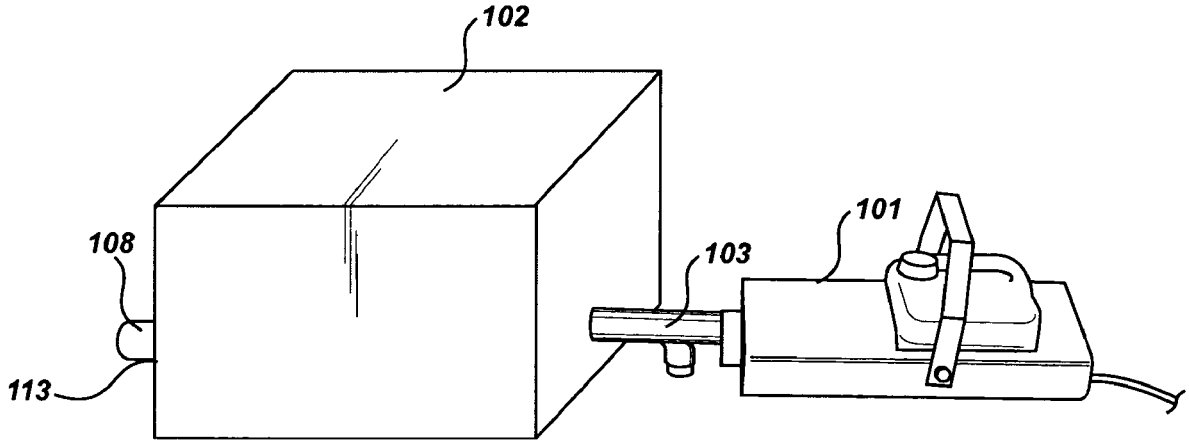
FIG. 8 is an isometric view of a preferred embodiment of the present invention.
Figure 9:
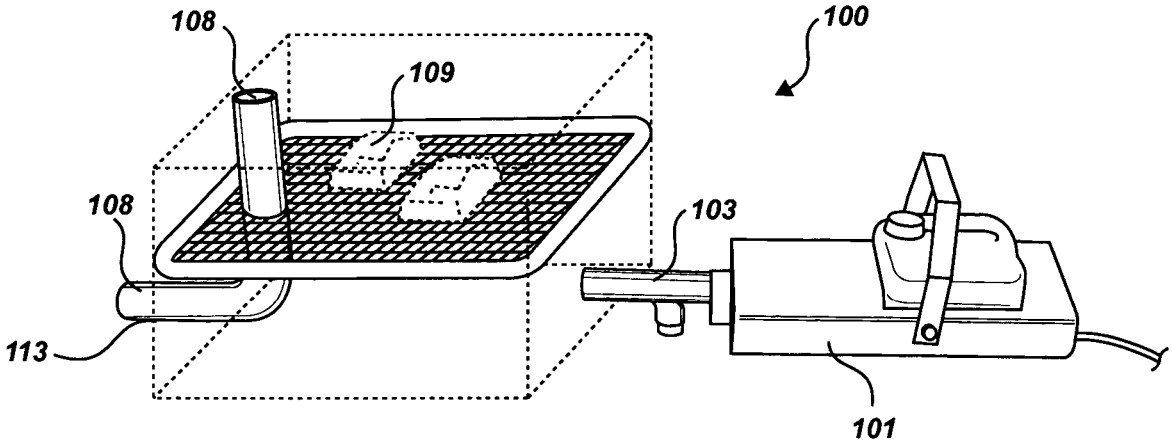
FIG. 9 is an isometric view of a preferred embodiment of the present invention.

FIGS. 8 and 9 illustrates an alternative preferred embodiment of the chamber 102. Chamber's 102 size and shape will be dictated primarily by factors of portability, capacity, and economic factors. Materials used to compose chamber 102 in a preferred embodiment is a plastic material. However, other equally expedient materials may also comprise chamber 102.

Figure 3:
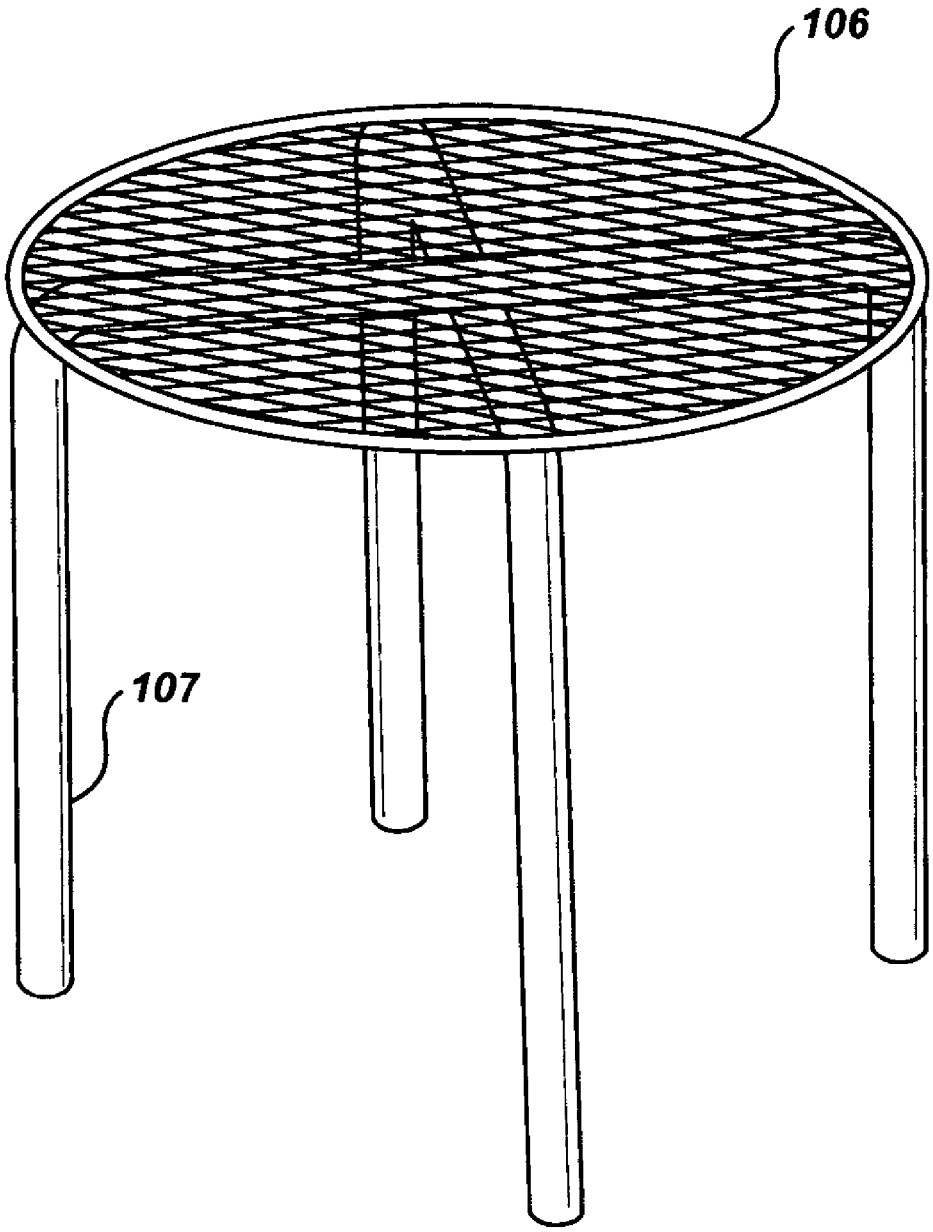
FIG. 3 is an isometric view of a preferred embodiment of the present invention.
Figure 4:
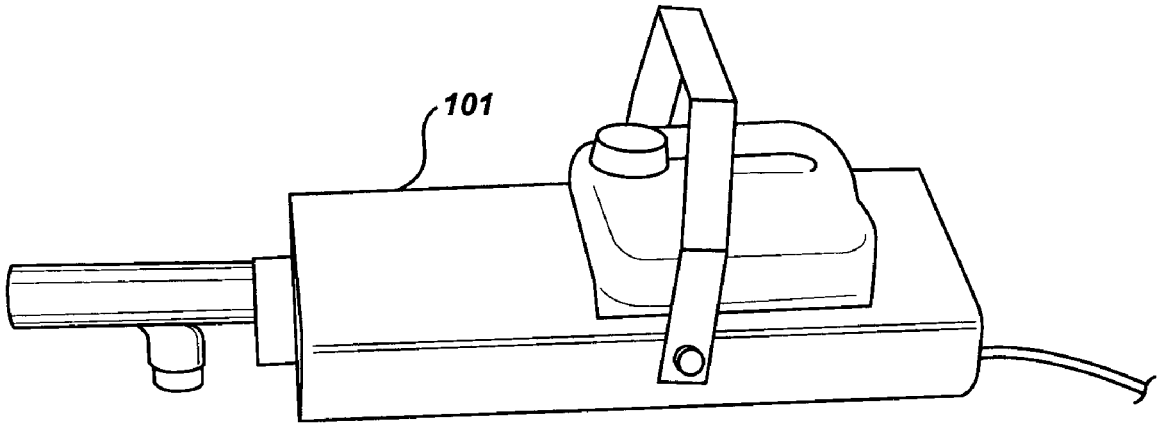
FIG. 4 is an isometric view of a preferred embodiment of the present invention.
Figure 5:
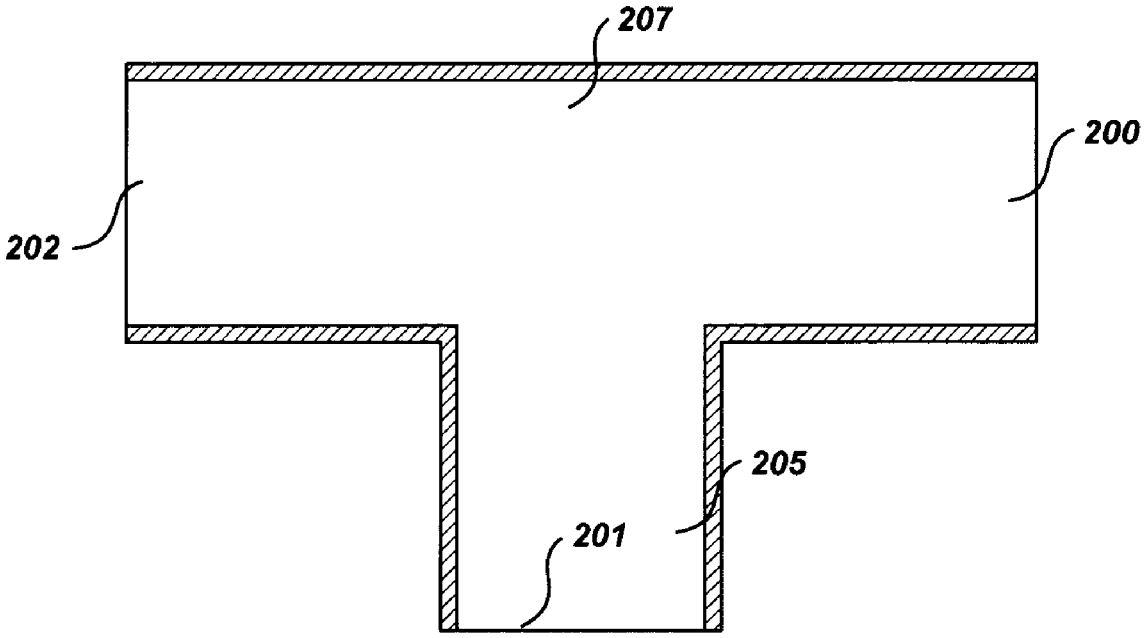
FIG. 5 is an isometric view of a preferred embodiment of the present invention.
Figure 6:
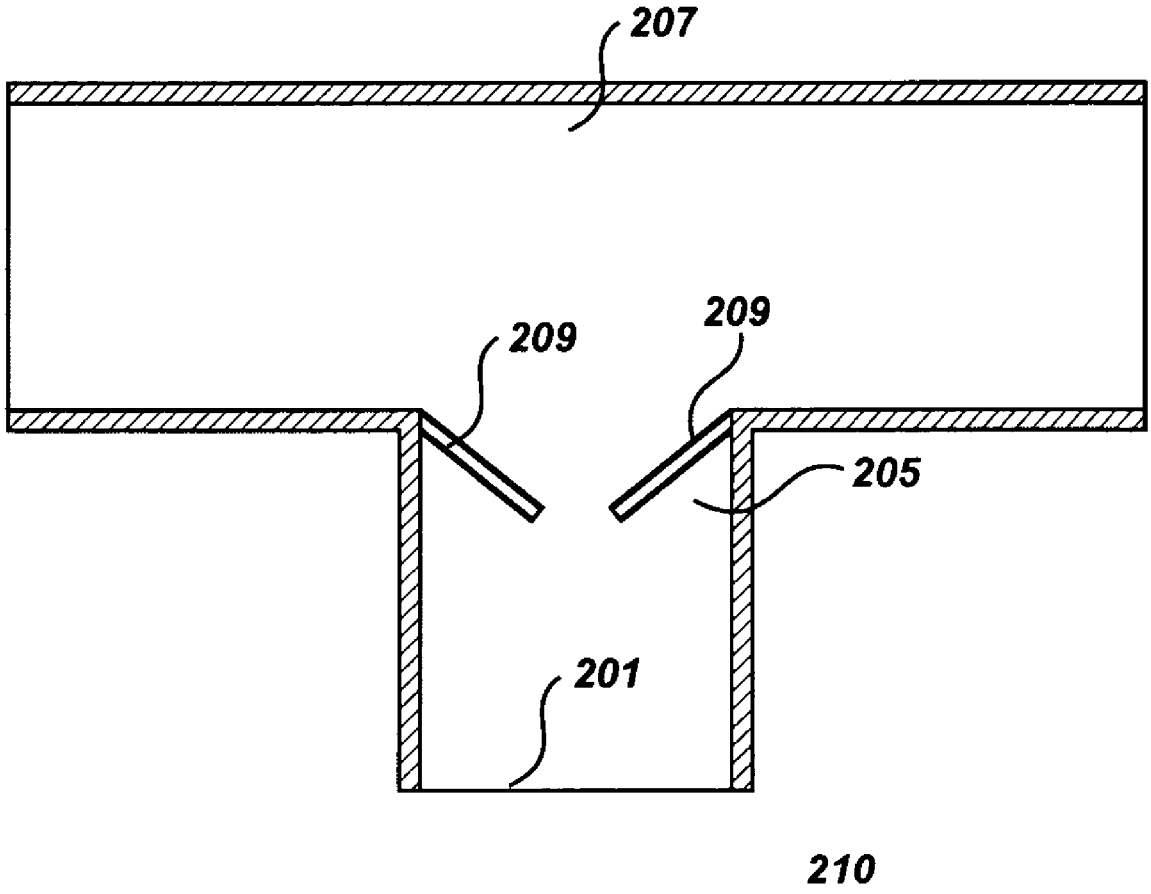
FIG. 6 is an isometric view of a preferred embodiment of the present invention.
Figure 7:
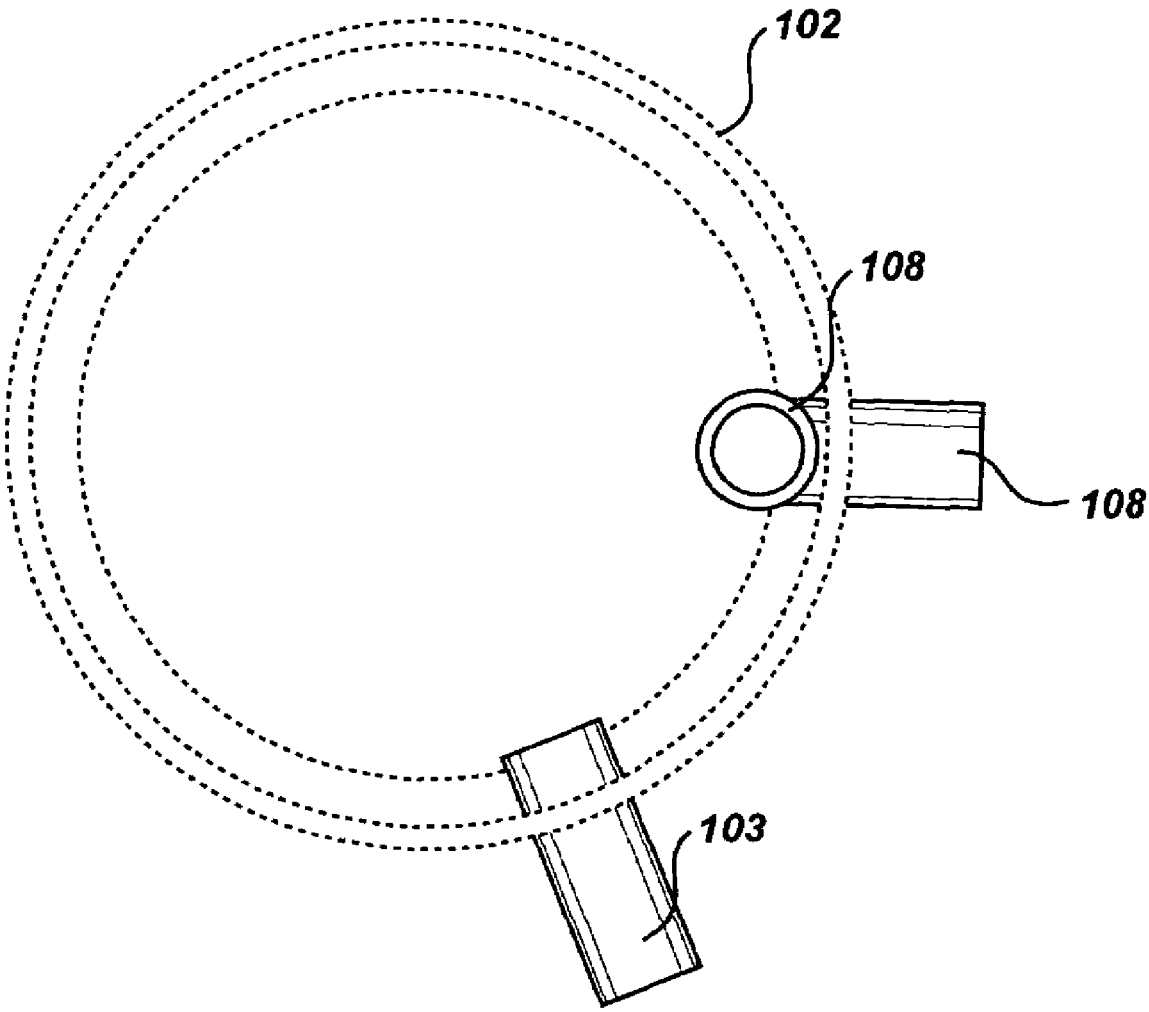
FIG. 7 is an isometric view of a preferred embodiment of the present invention.

Located in chamber 102 is the support apparatus 107 as seen in FIGS. 2 and 3. Support apparatus 107 is used for supporting ice tray 106 and ice 109. Although support apparatus 107 in a preferred embodiment is made of PVC piping material, other equally expedient means for supporting ice tray 106 and ice 109 abound. For instance, flanges may be affixed to the inside walls of chamber 102 to support both ice 109 and ice tray 106. In other preferred embodiments ice tray 106 may be affixed to walls of chamber 102 by soldering, glue, additional orifices in chamber 102, etc. The number of alternative embodiments for support apparatus 107 are endless. Therefore, the specific means for support apparatus 107 is of no consequence to the present invention.

Ice tray 106 consists of a grill-like article of manufacture. Ice tray 106 supports ice 109. Ice tray 106 may embody a panoply of different shapes and sizes. In a preferred embodiment, ice tray 106 is made of a lightweight metal. However, in other preferred embodiments, ice tray 106 may be made of plastic or other suitable material. In addition, ice tray 106 may also be a net of flexible material. The possibilities are endless. Thus, the specific means by which the ice 109 is supported is of no consequence.

Figure 10:
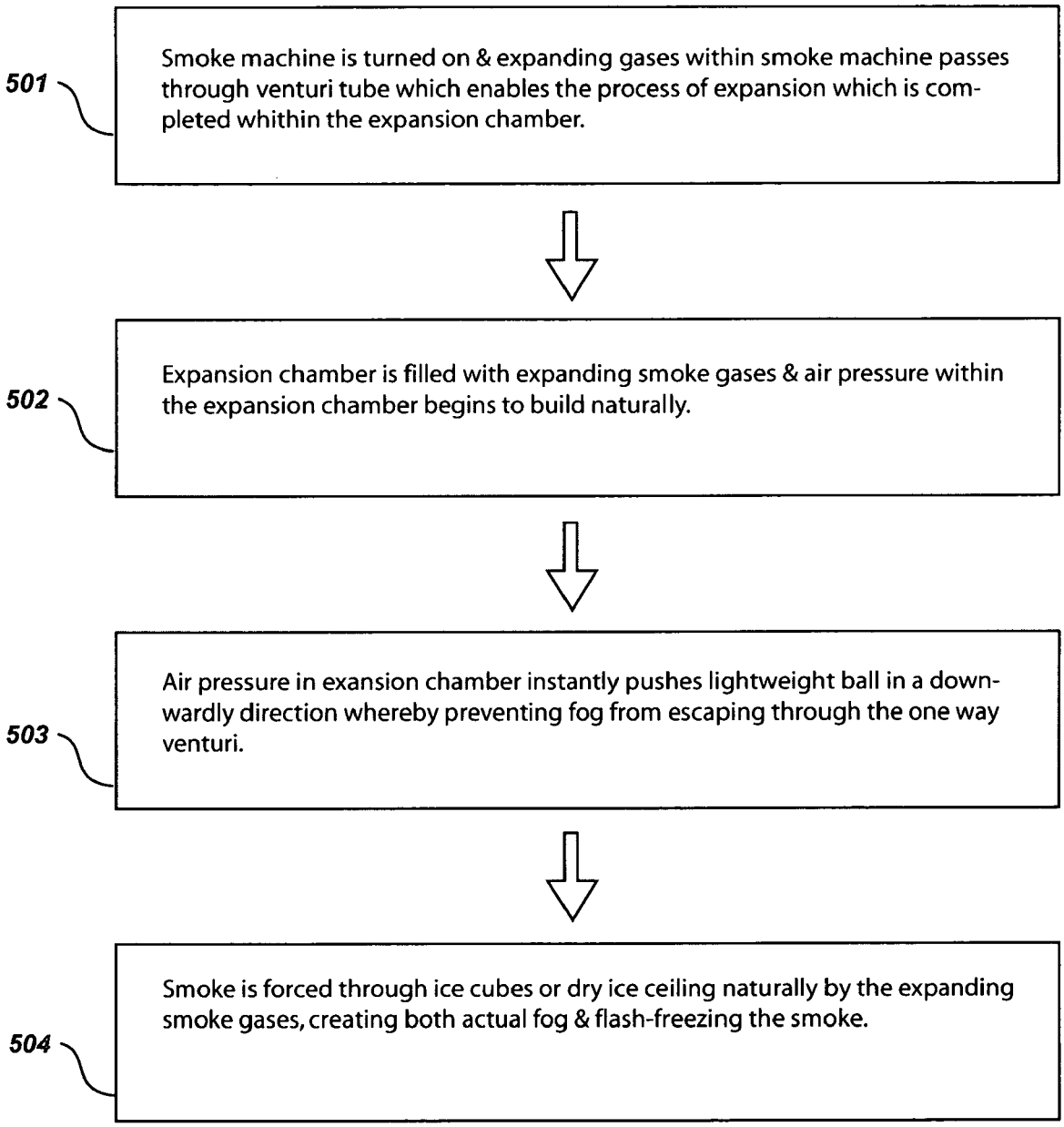
FIG. 10 is a flow diagram of a preferred embodiment of the present invention.

FIG. 10 illustrates a preferred method to be used in conjunction with the present invention. In step one 501, smoke machine 101 is turned on and the expanding gases within smoke machine 101 passes through venturi apparatus 103 or inlet orifice 125 which enables the process of expansion which is completed within expansion chamber 102. This step facilitates the expansion of smoke within the expansion chamber 110. In step two 502, flash freeze chamber 111 is filled with expanding smoke gases and air pressure within the expansion chamber 110 begins to build naturally. In step three, 503 air pressure in expansion chamber 110 instantly pushes gate means 209 in a closed position thereby preventing smoke from escaping through the one-way venturi 103. (It should be pointed out here that gate means may be operated in conjunction with an electronic apparatus commonly used in the art) This step also facilitates the expansion of the smoke within the expansion chamber 110. This step also harnesses natural pressure from expanding smoke gases inside the expansion chamber 110 which is the main engine in forcing smoke out of the expansion chamber 110. In step four 504, smoke is forced through ice cubes or dry ice ceiling (in some preferred embodiments smoke is forced directly out the exhaust where there is no cooling means) naturally by the expanding smoke gases, creating both actual fog and flash freezing the smoke. Eventually these natural forces result in fog and smoke to find its way out of cfgnsfds 100 via vortex orifice and out from the exhaust duct 108.

It will be apparent to the skilled artisan that there are numerous changes that may be made in embodiments described herein without departing from the spirit and scope of the invention. For instance, instead of using regular ice or dry ice to cool the smoke or fog, a refrigerator or other cooling means may be used to cool the fog. The ways of cooling the fog are endless. Also, the gate means in the venturi 103 may be operated in conjunction with an electronic apparatus commonly used within the art. As such, the invention taught herein by specific examples is limited only by the scope of the claims that follow.

What is claimed is:

1. A venturi apparatus for use with a cold fog generator and smoke/fog delivery system comprising:

a pipe, said pipe comprising: a smoke producing means chamber, a cfgnsfds chamber, and an ambient air chamber, said smoke producing means chambers sized to fit with a smoke producing means, said cfgnsfds chamber sized to fit with a cfgnsfds, said cfgnsfds chamber and said smoke producing means chamber located directly opposite each other, said ambient air chamber located perpendicularly in relation to said cfgnstds chamber and said ambient air chamber.

2. The venturi apparatus of claim 1 wherein said smoke producing means chamber has an outside surface which is complimentarily threaded to receive said smoke producing means which is also threaded.

3. The venturi apparatus of claim 1 wherein said cfgnsfds chamber has an outside surface which is complimentarily threaded to receive said cfgnsfds which is also threaded.

4. The venturi apparatus of claim 1 wherein said ambient air chamber houses a gate means for shutting off air flow.

5. The venturi apparatus of claim 1 wherein said ambient air chamber houses a reed means for shutting off air flow.

6. The venturi apparatus of claim 1 wherein ambient air chamber houses a gate for shutting off air flow.

7. The venturi apparatus of claim 1 wherein said pipe is made of PVC.

8. The venturi apparatus of claim 1 wherein said pipe is made of metal.

9. The venturi apparatus of claim 1 wherein said smoke producing means chamber has an inner surface which is complimentarily threaded surface to receive said smoke producing means which is also threaded.

10. The venturi apparatus of claim 1 wherein said cfgnsfds chamber has an inner surface which is complimentarily threaded to receive said cfgnsfds which is also threaded.

11. The venturi apparatus of claim 1 wherein said ambient air chamber houses a spring means for operation with a gate for shutting off air flow.

12. The venturi apparatus of claim 5 wherein said pipe is made of PVC.

13. The venturi apparatus of claim 5 wherein said pipe is made of metal.

14. The venturi apparatus of claim 5 wherein said smoke producing means chamber has an inner surface which is complimentarily threaded surface to receive said smoke producing means which is also threaded.

15. The venturi apparatus of claim 5 wherein said cfgnsfds chamber has inner surface which is complimentarily threaded to receive said cfgnsfds which is also threaded.

16. The venturi apparatus of claim 3 wherein said ambient air chamber houses a reed means for the purpose of shutting off air flow.

17. The venturi apparatus of claim 3 wherein said ambient air chamber houses a gate means for the purpose of shutting off air flow.

18. The venturi apparatus of claim 5 wherein said smoke producing means chamber has an outside surface which is complimentarily threaded to receive said smoke producing means which is also threaded.

* * * * *